United States Patent [19]

Morita et al.

[11] Patent Number: 5,052,883

[45] Date of Patent: Oct. 1, 1991

[54] IMPLEMENT POSITIONING CONTROL SYSTEM FOR CONSTRUCTION MACHINES

[75] Inventors: Izuru Morita, Tokyo; Shoji Tozawa; Yoshitaka Sakata, both of Kobe; Muneo Katano, Sagamihara; Ryuzo Maeda, Atsugi, all of Japan

[73] Assignee: Caterpillar Inc., Peoria, Ill.

[21] Appl. No.: 460,835

[22] PCT Filed: Aug. 18, 1989

[86] PCT No.: PCT/US89/03525

§ 371 Date: Feb. 1, 1990

§ 102(e) Date: Feb. 1, 1990

[87] PCT Pub. No.: WO90/02230

PCT Pub. Date: Mar. 8, 1990

[30] Foreign Application Priority Data

Aug. 31, 1988 [JP] Japan ..... 63-218215

[51] Int. Cl.[5] ..... E02F 3/28

[52] U.S. Cl. ..... 414/700; 60/426; 91/522

[58] Field of Search ..... 414/698, 699, 700, 701, 414/685; 60/426; 91/522, 521, 523, 530

[56] References Cited

U.S. PATENT DOCUMENTS

| | | | |
|---|---|---|---|
| 3,265,229 | 8/1966 | Koch . | |
| 3,429,471 | 2/1969 | Austin et al. . | |
| 3,432,057 | 3/1969 | Goth . | |
| 3,487,968 | 1/1970 | Long | 414/701 |
| 3,506,149 | 4/1970 | Gray . | |
| 3,522,897 | 8/1970 | Greedy . | |
| 3,698,583 | 10/1972 | Shore . | |
| 3,792,640 | 2/1974 | Shore | 91/358 A |
| 3,836,032 | 9/1974 | Geier | 414/701 X |
| 4,011,959 | 3/1977 | Papasideris | 335/205 X |
| 4,024,974 | 5/1977 | Hodge | 172/466 X |
| 4,074,690 | 2/1978 | Adams et al. | 137/344 |
| 4,126,340 | 11/1978 | Pelcin | 292/1 |
| 4,141,258 | 2/1979 | Walzer | 74/540 |
| 4,185,661 | 1/1980 | Gill et al. | 135/625.65 |
| 4,195,551 | 4/1980 | Schmiel | 91/358 |
| 4,343,588 | 8/1982 | Styck | 414/701 |
| 4,372,729 | 2/1983 | Buschbom et al. | 414/700 |
| 4,516,117 | 5/1985 | Couture et al. | 414/701 X |
| 4,844,685 | 7/1989 | Sagaser | 414/699 X |

*Primary Examiner*—Robert J. Spar
*Assistant Examiner*—Donald W. Underwood
*Attorney, Agent, or Firm*—Robert E. Muir; James R. Yee

[57] ABSTRACT

A work vehicle (2) having an implement position controller (50). Set elevations and orientations of the work implement (5) can be preselected and changed. The controller (50) automatically positions the implement (5) in the desired elevation and orientation. Means (51) for preventing the work implement (5) from falling into the ground are also provided.

10 Claims, 8 Drawing Sheets

5
3
4
4a
6
7
6a
5
8
9
10
11
12
12
S1
S2
50
52
53
51
54
51a
I/O
15
13
63
62
70
61
60
18
19

START
1
INITIALIZE
1-2
CHANGE DATA?
Y
N
2
INPUT DATA
2-2
TEST MODE?
Y
N
3
TEST HARDWARE
4
COMPUTE HEIGHT OF P1,(P)
5
BUCKET RISING?
N
A
Y
6
H ≥ H LOW?
Y
N
7
TURN GROUND STOP FLAG OFF
8
UPPER LIFT KICKOUT ON?
N
Y
9
H ≥ HUPP ?
Y
N
10
ENERGIZE LIFT SOLENOID
B
C
11
DE-ENERGIZE LIFT SOLENOID
E
D

A
17
BUCKET LOWERING?
N
Y
17-2
GROUND STOP FLAG ON?
N
Y
B
18
GROUND STOP ON?
N
Y
C
19
COMPUTE HEIGHT OF BUCKET END, (Q)
20
Q ≤ 100mm?
Y
N
21
H ≤ HLOW-50mm?
N
Y
21-2
TURN GROUND STOP FLAG OFF
22
LOWER LIFT KICKOUT ON?
N
Y
22-2
ENERGIZE LIFT SOLENOID
23
DELAY FOR 0.5 SEC.

IMPLEMENT POSITIONING CONTROL SYSTEM FOR CONSTRUCTION MACHINES

DESCRIPTION

1. Technical Field

The present invention relates to an implement positioning device for bucket loaders and more specifically to an electronic control device for automatically positioning the bucket in a plurality of preselected elevations and orientations.

2. Background Art

Conventional loaders includes a bucket pivotally connected to a lift arm. The lift arm is pivotally mounted to the loader frame. The lift arm and the bucket are interconnected by a tilt linkage including a hydraulic cylinder and a tilt valve with two operating positions and a non-operating position. The valve is controlled by an operator through a tilt lever which is spring-held in a neutral position. While the tilt lever is in the neutral position, the hydraulic valve is in the non-operating position and the bucket is held at its current position. The tilt lever can be moved in two directions corresponding to the two operating positions of the tilt valve. Movement of the valve to one operating position causes the bucket to pivot downward, towards the dump position. While movement of the valve to the other operating position causes the bucket to pivot in the opposite direction towards the rack-back position.

Movement of the lift arm is controlled in a similar manner. The hydraulic lift valve, however, has two operating positions and two non-operating positions. The lift valve is controlled by the operator through a lift lever also spring-held in a neutral position. The operating positions correspond to raising and lowering the lift arms. While the lift lever is in the neutral position he lift arms are held stationary. In the second non-operating position, the bucket is allowed to float and follows the contour of the work surface.

Normally, a loader is adapted to perform digging loading, carrying, and during operations. For example, in a typical work cycle, the loader is used to load a pile of material into a dump truck. There are three positions associated with the cycle: load, carry and dump. Normally, the operator must manipulate the two levers to position the bucket. First the bucket is positioned low and nearly level to the ground to load the bucket. The bucket is then raised for carrying. Finally when the bucket is placed over the dump truck, the bucket is tilted forward to dump its contents.

It is known, to use detented levers for positioning the bucket in a set elevation and orientation. The detent mechanism can be manually or electrically operable. With such a mechanism, the operator need only push the lever into the detented (locked) positions. When the bucket reaches the set position, a kickout mechanism will release the lever stopping movement of the bucket.

In U.S. Pat. No. 3,522,897, issued Aug. 4, 1970, to A. L. Freedy, a kickout control for bucket loaders is disclose. The described system employs a mechanically actuated kickout valve positioned on a lift arm and in such relation to the tilt linkage a to stop the bucket in a dump position. However, due to adverse working conditions, the accuracy and reliability of the system is dependent on frequent cleanings. Also, adjustment of the system must be done rom outside the operator's cab.

In contrast, in U.S. Pat. No. 3,432,057 issued on Mar. 11, 1969, to G.L. Goth, the detent mechanism is unlocked by an electrically actuated solenoid. However, the solenoid is triggered by the closing of a limit switch an requires the same sort of maintenance and adjustments, as stated previously.

In the work cycle described above, a bucket loader places material into a dump truck. Usually, a number of dump trucks is used. When one truck is full, another takes its place. The trucks may vary in height, changing the dump height. Having a maximum constant dump height decreases the efficiency of the cycle. It is desirable to have the ability to change the dump height. Likewise, it is advantageous, to have the ability to change all the kickout parameters from the operator's seat.

The present invention is directed to overcoming one or more of the problems as set forth above.

DISCLOSURE OF THE INVENTION

It is an object of the present invention to provide an automatic position control system for a material loading vehicle. The vehicle has a pivotally moveable bucket connected to a pivotally moveable lift arm. The bucket and lift arm are controllably and independently moveable to a multiplicity of preselected positions. The vehicle also has a power system including a hydraulic pump operably connected to a plurality of hydraulic cylinders for controllably moving the bucket and lift arm.

A first lever has locked and unlocked positions for raising the lift arm and bucket and a position for lowering the lift arm and bucket. A second lever has locked and unlocked positions for pivoting the bucket in a first direction and a position for pivoting the bucket in a second, different direction. The first and second levers are positioned in a power system at a location between the pump and the respective cylinders.

The elevation of the bucket is sensed and an elevation signal (E) responsive to the elevation of the bucket is delivered. The orientation of the bucket is sensed and an orientation signal (O) responsive to the orientation of said bucket is delivered. A set point elevation signal (E') and a set point orientation signal (O'), responsive to respective preselected elevation and orientation positions of the bucket are delivered. The position signal, (E) and (E') and the orientation signals (O) and (O') are compared. An elevation control signal (EC) is delivered in response to the bucket being at the preselected elevation. An orientation control signal (OC) is delivered in response to the bucket being at the preselected orientation. The first lever is moved from the locked to the unlocked position in response to receiving the elevation control signal (EC). And the second lever is moved from the locked to the unlocked position in response to receiving the orientation control signal (OC).

BEST MODE FOR CARRYING OUT THE INVENTION

The preferred embodiment applied to a wheel type loader of an implement positioning control system for construction machine in accordance with this invention is described a follow.

Figure 1:
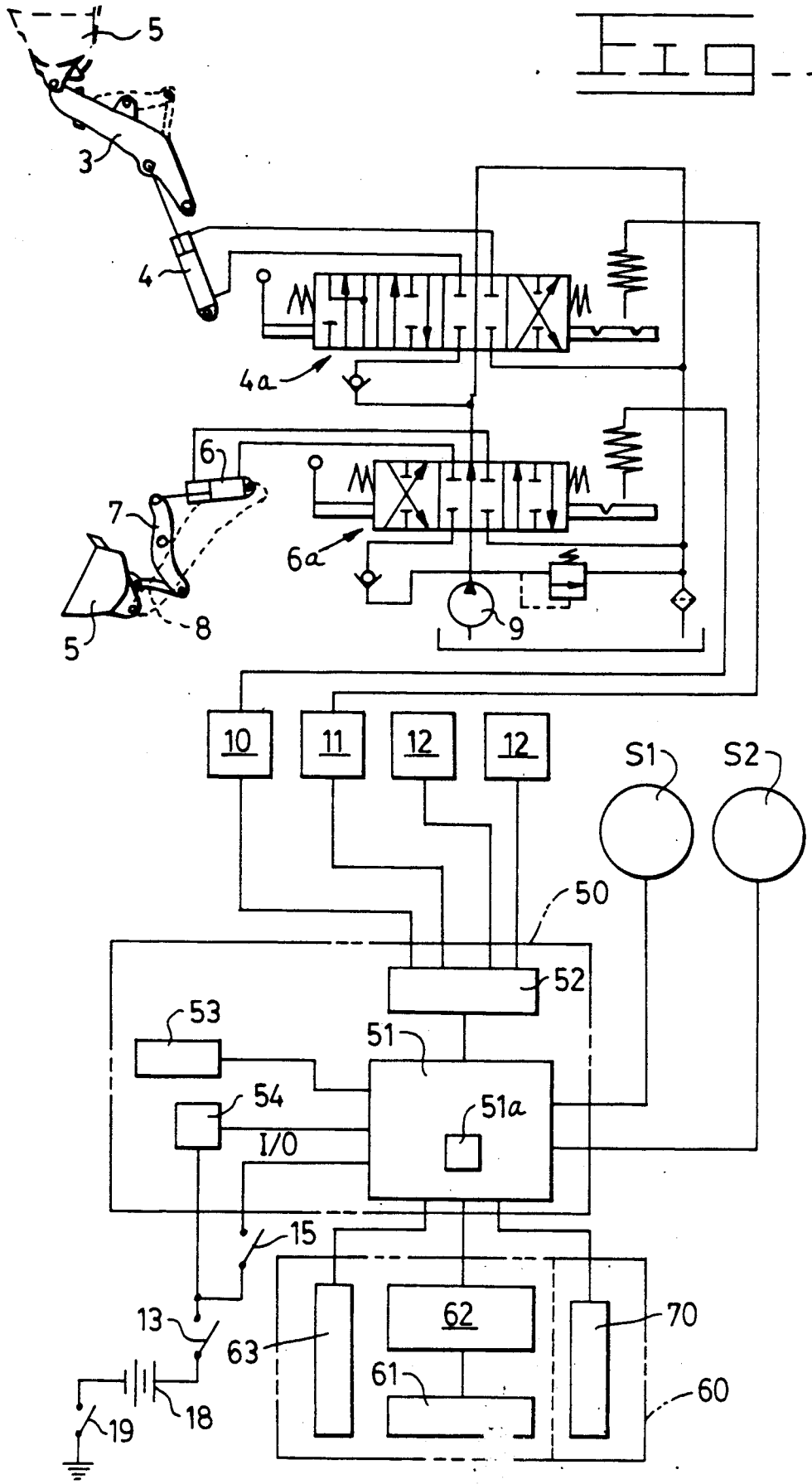
FIG. 1 is a schematic block diagram of the embodiment for the equipment positioning control system.
Figure 2:
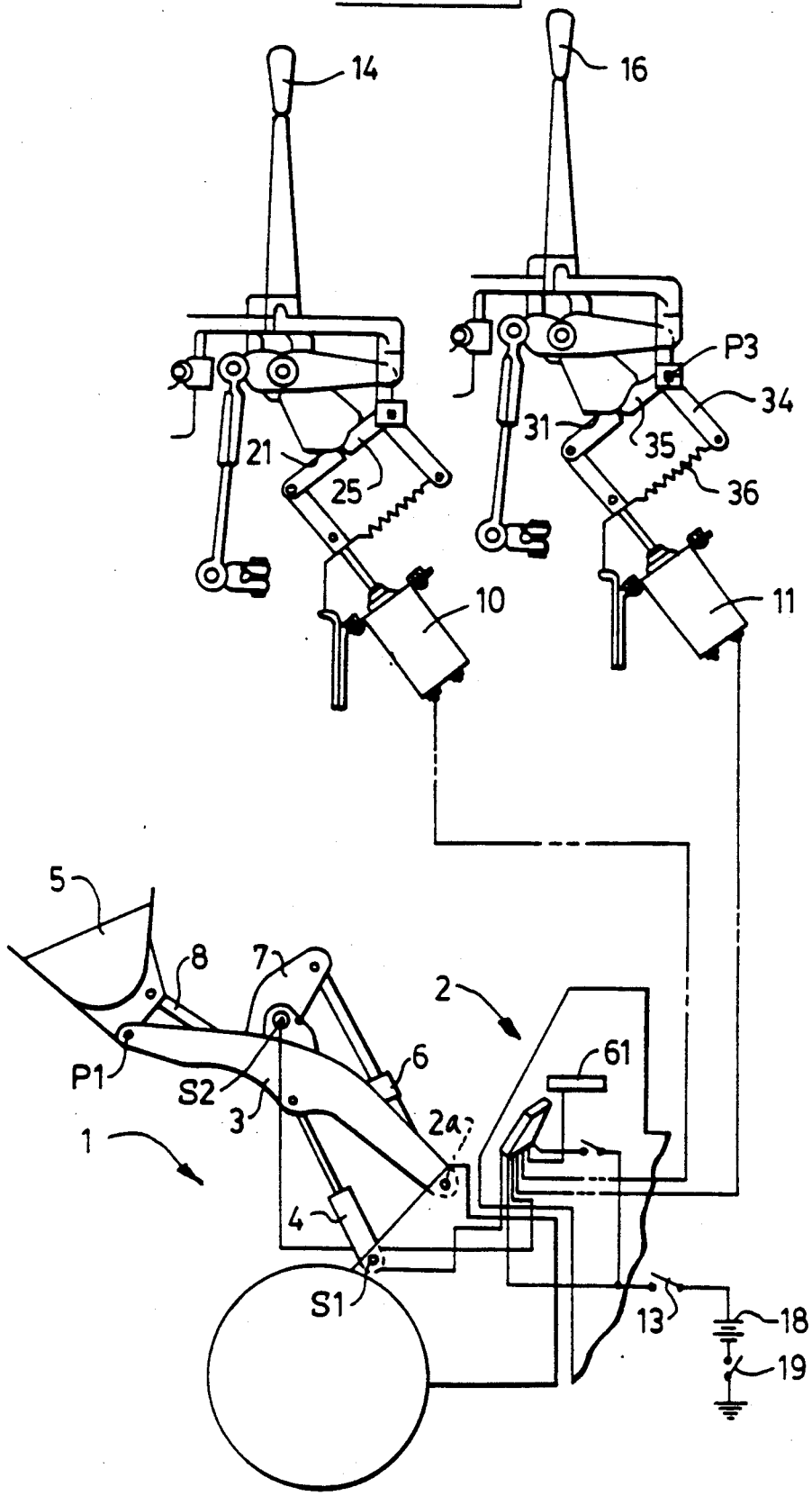
FIG. 2 is a schematic diagram of the embodiment.
Figure 3:
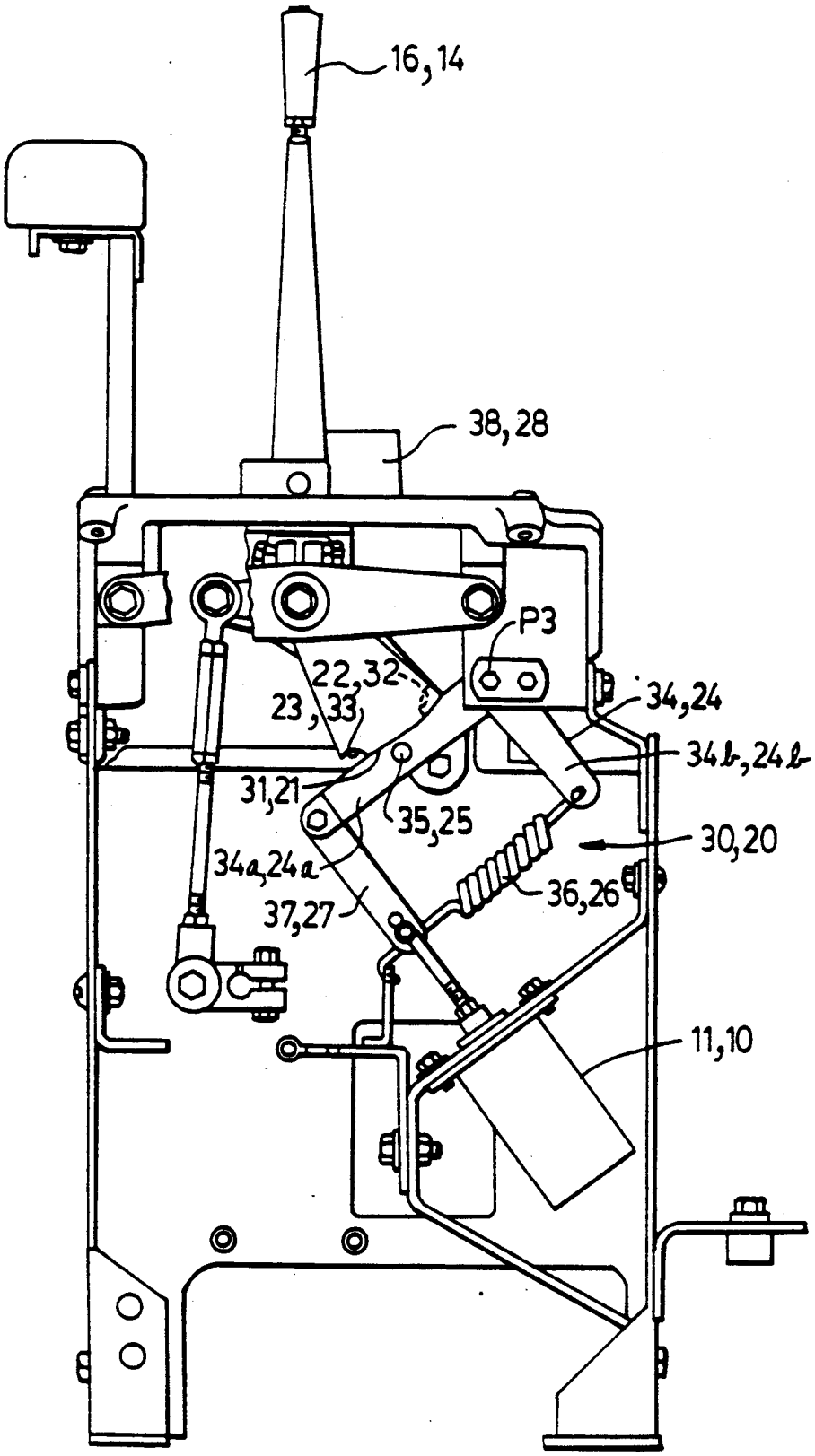
FIG. 3 is a side view showing a construction of a control lever locking device.

A wheel type loader 1, a shown in FIG. 1 and FIG. 2, comprises a lift arm 3 pivotally mounted on a bracket 2a secured at the front end of a vehicle 2. A lift cylinder 4 actuates the lift arm 3 and a bucket 5 which is mounted on the front end of the lift arm 3. A tilt cylinder 6 pivots the bucket 5, through a tilt link lever 7 and a linkage rod 8.

This well-known composition enables bucket 5 to be tilted and lifted. The lift cylinder 4 and the tilt cylinder 6 are controlled by a lift control valve 4a and a tilt control valve 6a, respectively. Control valves 4a, 6a are positioned in a power system 17, between a hydraulic pump 9 and the cylinders 4 and 6.

As shown in FIG. 1 the lift control valve 4a has four positions: FLOAT, LOWER, HOLD, and RAISE.

The tilt control valve 6a has three positions: TILT-BACK, HOLD, and DUMP.

The lift control valve 4a and the tilt control valve 6a are connected to a lift control lever 14 and a tilt control lever 16. The levers 14, 16 are manually operated and usually held in neutral or the HOLD position by a spring installed in the control valve 4a, 6a.

The lift control lever 14 and the tilt control lever 16 are equipped with locking mechanisms 20 and 30, respectively.

The locking mechanisms 20, 30 are equipped with cams 21, 31 respectively. Locking mechanism 20 has detent portions 22, 23 and locking mechanism 30 has a detent portion 32. Said locking mechanisms 20, 30 are operated by movement of said control levers 14 and 16.

The lift control lever 14 includes a lift control lever position sensor 28. The tilt control lever 16 includes a tilt control lever position sensor 38.

The lift control lever 14 is snapped over the detent 2 an over the detent 23 in the LOWER and in the RAISE position of the lift control valve 4a, respectively. The tilt control lever 16 is snapped over the detent 32 in the TILT-BACK position of the tilt control valve 6a.

In addition, a detent portion 33 may be provide at the rear end of the cam 31 corresponding to the DUMP position of the tilt control lever 14.

L-shaped levers 34, 24 having front pieces 34a, 24a and rear pieces 34b, 24b are pivotally connected at a pivot point P3. Cam rollers 35, 25 are connected to the front pieces 34a, 24a.

Tension spring 36, 26 are hooked to the rear pieces 34b, 24b so that the cam rollers 35, 25 are in contact with the cams 31, 21.

Said construction of the locking mechanisms 30, 20 lock the control levers 16, 14 into respective positions when the cam rollers 35, 25 roll over the cams 31, 21 and are locked into the detent portion.

Also, the construction allows an operator to overcome the specific force of the locking mechanisms 30, 20, releasing the cam roller 35, 25 from said detent portion. The control levers 16, 14 are returned to the neutral (HOLD) position.

Unlocking levers 37, 27 are rotably mounted to front pieces 34a, 24a. Electromagnetic solenoids 11, 10 are hooked to the unlocking levers 37, 27.

The unlocking levers 37, 27 are pulled in to the unlocking direction of the control levers 16, 14 when the electromagnetic solenoids 11, 10 are energized.

When the unlocking levers 37, 27 are pulled, the L-shaped levers 34, 24 are rotated around the pivot point P3 and the cam roller 35, 25 are pulled from contact with the cams 31, 21.

The cam rollers 35, 25 are released from the detent portions 33, 32, 23, 22 and the control levers 16, 14 are returned to neutral (HOLD) positions automatically by the spring installed within the control valves 6a, 4a.

A lift sensor S1 is provided to detect a height of the lift arm 3 and to deliver an elevation signal (E) indicative of the height of the lift arm 3.

A tilt sensor S2 is provided to detect an angle of the bucket 5 and to deliver an orientation signal (O) indicative of the angle of the bucket 5.

Figure 4:
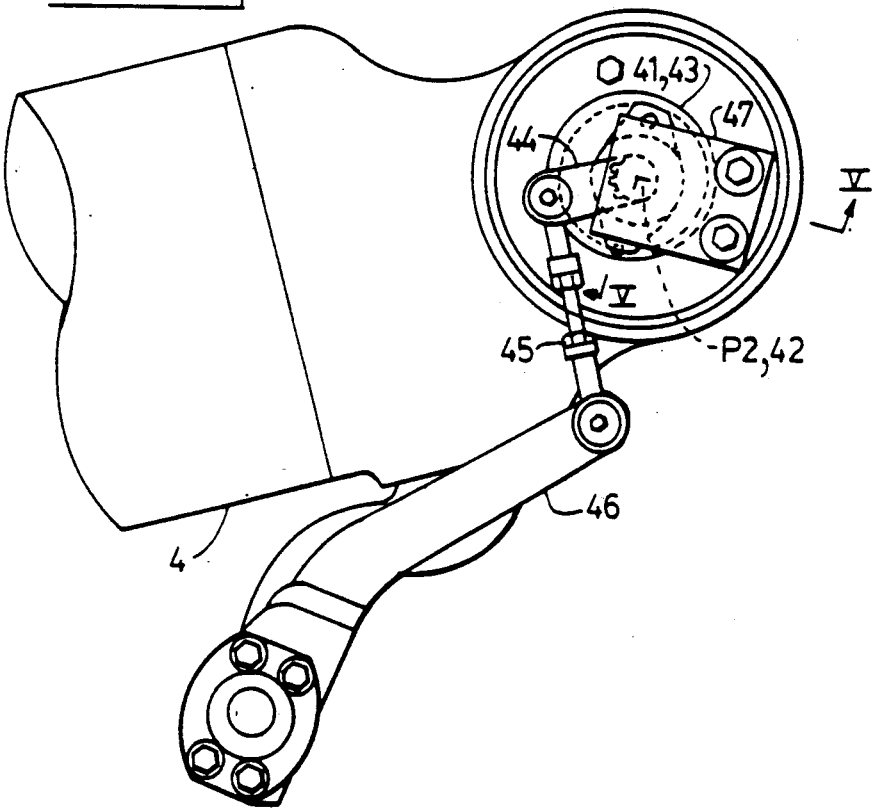
FIG. 4 is a plane view of a lift sensor.
Figure 5:
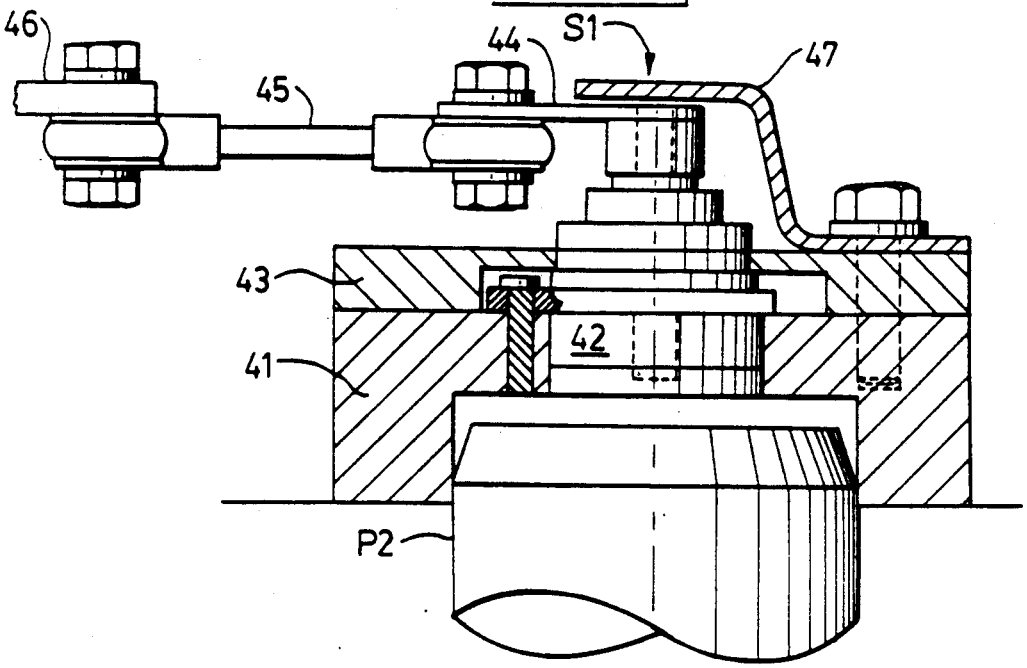
FIG. 5 is a sectional view taken along line V—V corresponding to FIG. 4.

The lift sensor S1, as shown in FIG. 4 and FIG. 5, is installed around the pivot pin P2 of the lift cylinder 4.

A sensor installing plate 41 encloses a sensor body 42 of the lift sensor S1.

A sensor lever 44 extends horizontally from the center of the sensor body 42, and is jointly connected through a rod linkage 45 to a bracket 46 extended from the lift cylinder 4.

A sensor lever protective plate 47 covers the outside of the sensor lever 44 and also prevents the sensor lever 44 from being knocked off.

The composition of the lift sensor S1 as stated above effectively senses the rotation of the lift cylinder's pivot point P2.

Figure 6:
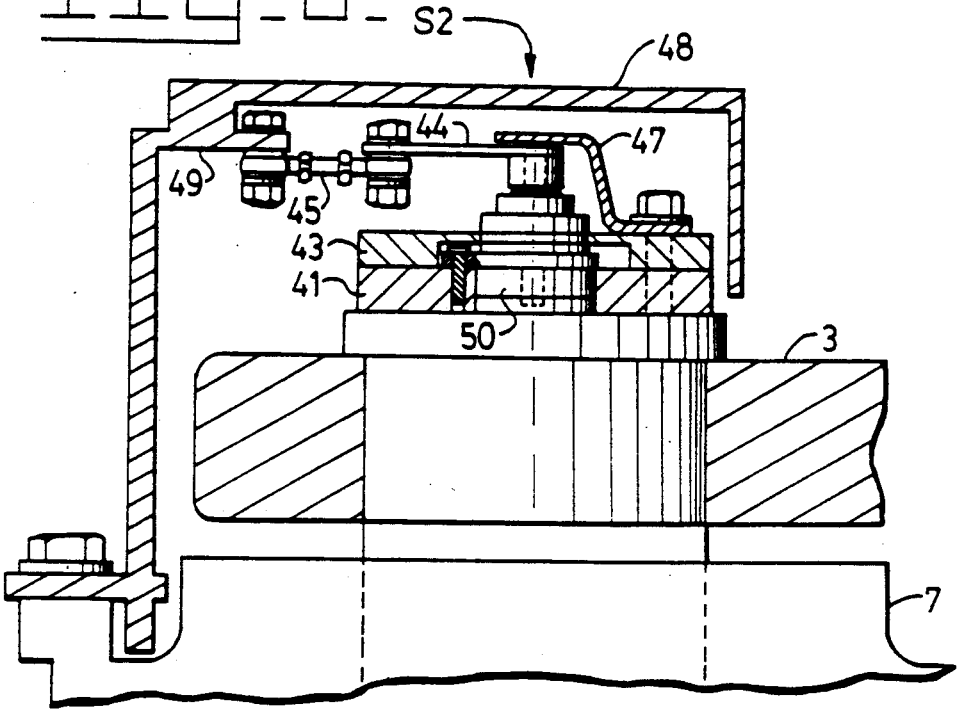
FIG. 6 is a sectional view taken along line VI—VI corresponding to FIG. 7.
Figure 7:
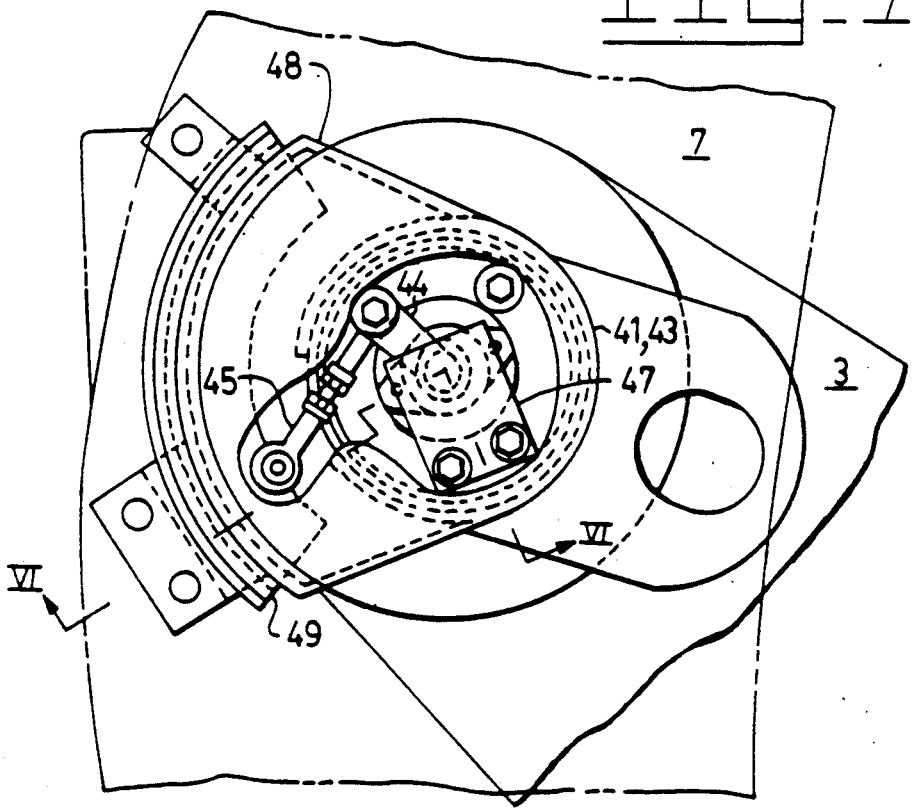
FIG. 7 is a plane view of a tilt sensors.

The tilt sensor S2, as shown in FIGS. 6 and 7 is similar to said lift senor S1 in composition, but effectively senses the rotation angle of the tilt link lever 7.

A sensor installing plate 41 encloses a sensor body 42 of the lift sensor S2.

A protective cover 48 is provided to protect sensor S2 from obstacles such as rocks and stones.

A sensor lever 44 extends from the center of the sensor body 42, and is jointly connected through a rod linkage 45 to the tilt link lever 7.

A sensor lever protective plate 47 covers the outside of the sensor lever 44 and also prevents the sensor S2 from being knocked off.

In FIGS. 4, 5, 6, and 7 the same numbers are used for the same components of the lift sensor S1 as those of the tilt sensor S2.

The signals (E), (O) from the lift sensor S1 and the tilt sensor S2 are received by an implements positioning controller 50.

The implements positioning controller 50 comprises a control portion 51, a electromagnetic solenoid driver 52, a memory of ROM 53, and an electric power circuit 54 (see FIG. 1).

The control portion 51 includes a microcomputer furnished with CPU, a parallel I/O, memory (RAM, EEPROM), and an A/D converter.

The electromagnetic solenoid driver 52 energizes the electromagnetic solenoids 10 and 11 when the control portion 51 transmits elevation control signals (EC and EC') and orientation control signals (OC and OC'), respectively. Energizing the solenoids 10, 11 unlocks the lift control lever 14 and the tilt control lever 16, as described previously. An auxiliary electromagnetic solenoid 12 may be provided.

Said electromagnetic solenoid driver 52 sends an abnormal operation signal to the implement positioning controller 50 when the electromagnetic solenoids 10, 11, 12 experience short circuits.

The electric power circuit 54 keeps the voltage of the battery constant and produces a voltage in which the microcomputer can be operated.

Figure 8A:
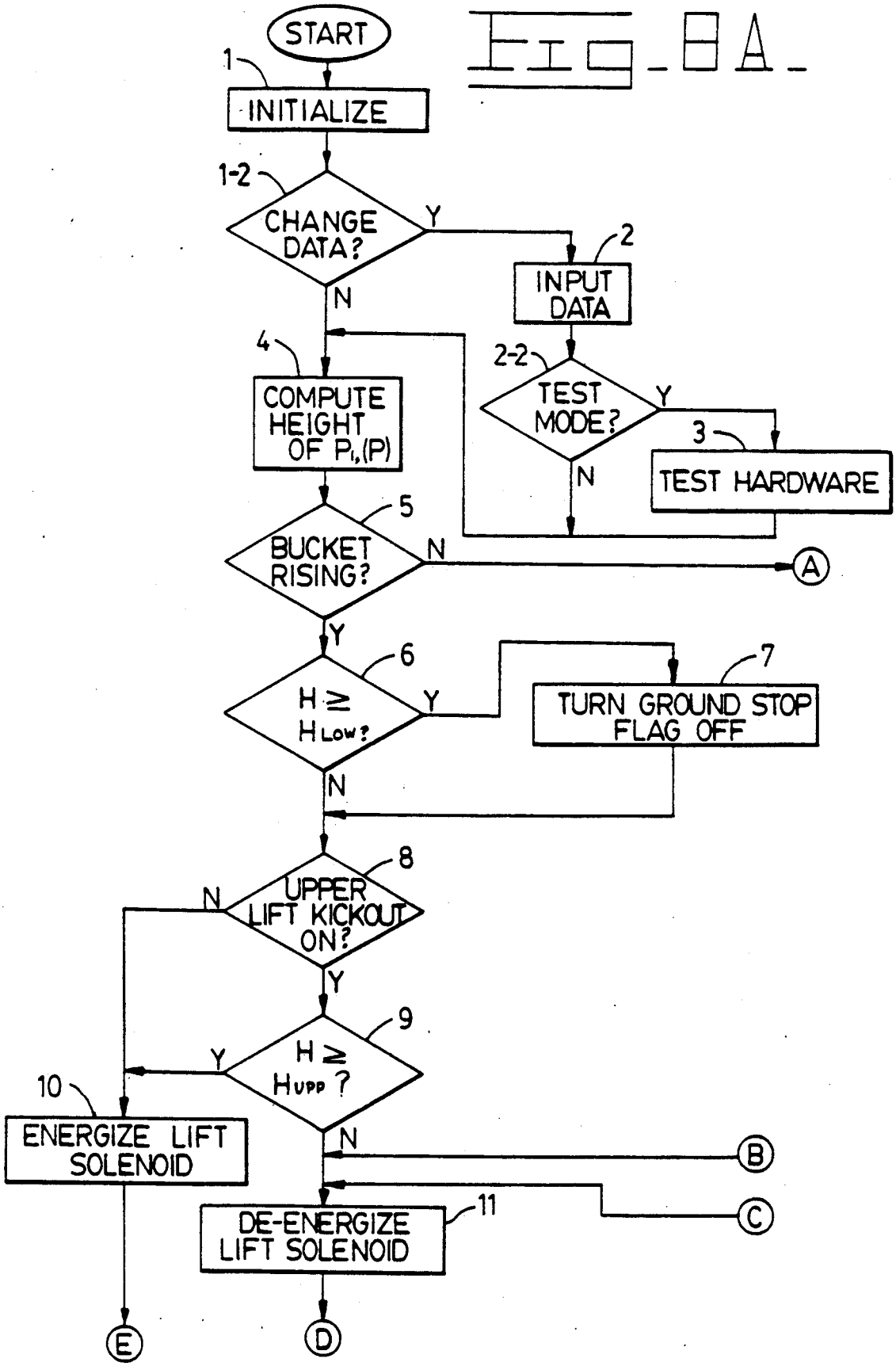
FIGS. 8a, 8b, and 8c are sections of a flow chart showing the processing for the implements positioning control system.

The implement positioning controller system program is memorized on the ROM 53 as described in the flow chart in FIGS. 8 (*a*), (*b*), and (*c*).

Said lift sensor S1 and tilt sensor S2 are connected to the input side of the implements positioning controller 50.

In this embodiment, potentiometers are used for the lift sensor S1 and the tilt sensor S2, however, an encoder or a resolver may be utilized in place of said potentiometer.

The electromagnetic solenoid 10, 11, 12 are connected to the output side of the implements positioning controller 50 through the electromagnetic solenoid driver 52.

The auxiliary electromagnetic solenoid 12 is utilized for a third control valve (not shown), and also as a shock-absorber for the bucket 5.

On the implements positioning controller 50, a display device 60 is provided as an external displaying means, and a number of input switches 70 are provided as the external input means. A disconnect switch 19, a main switch 13, and a light switch 15 are also provided.

The display device 60 comprise a display 61 such as a LCD, LCD controller driver 62, and a back light 63.

The height of the lift arms 3 and the tilt angle of the bucket 5, a detected by the lift sensor S1 and the tilt angle sensor S2, are shown on the display 61 in real time.

Various functions are provided by the input switches 70. More than one function may be provided for each switch 70.

Said input switches 70 predetermine data to be stored on a non-volatile memory 51*a* such as EEPROM.

The data to be stored on the non-volatile memory 51*a* in this embodiment is the following:

(1) An upper kickout position ($H_{upp}$)for a lift cylinder kickout, (2) A lower kickout position ($H_{low}$)for a lift cylinder kickout, and (3) A desired bucket tilt angle ($A_{set}$)for a tilt angle kickout.

$H_{upp}$ and $H_{low}$ are calculated by the controller based on set point elevation signals (E' and E'', respectively) received from the sensor S1. $A_{set}$ is calculated by the controller 50 based on a set point orientation signal (O') received from the sensor S2.

If the detent portion 33 is provided for dumping, a second bucket tilt angle, $A_{dmp}$, is calculated based on a second set point orientation signal (O'').

Said input switches 70 are used for writing said predetermined data on the non-volatile memory 51*a*.

When the height of the lift arms 3 and the tilt angle of the bucket 5 reach the predetermined height and angle of the bucket 5 by manual operation, the data of that position is displayed on the display 61 by means of the operation of the lift sensors S1 an the tilt sensor S2.

So an operator can write the above three types of predetermined data ($H_{upp}$, $H_{low}$, and $A_{set}$) on said non-volatile memory 51*a* by turning the switch 70 while monitoring the current position of the lift arms 3 and the bucket 5.

This switch 70 is used for inputting the height of the lift arm 3 and tilt angle of the bucket 5 as state above.

By means of this procedure, the three types of predetermined data are stored on the non-volatile memory 51*a*.

The redetermined data as input data is stored on the non-volatile memory 51*a* along with said current detected data by the lift sensor S1 and tilt sensor S2, and the stored predetermine data can be also called out in order by said switch 70.

The predetermined data can be changed according to the kinds of the operations of the implements (see FIG. 1).

The sequential process of the implements positioning control system is described based on a flow chart shown in FIGS. 8 (*a*) to (*c*) as follows:

When the main switch 13 is turned on, the implements positioning controller 50 starts and the program stored in the ROM 53 is loaded.

In step 1, the controller 50 is initialized. Various software parameters such as a Ground Stop Flag are also established.

In step 1-2 whether or not the input data is given by the switch 70 is judged. When the input data is given by the switch 70, processing proceeds to step 2. The data is inputted by the operator in step 2.

If the data is not to be changed, processing jumps to step 4.

In step 2-2 whether or not a test mode is effective is judged. If the test mode is effective, a hardware check is complete on the positioning controller's components in step 3.

If everything is functioning normally, processing proceeds to step 4.

In step 4, the height of the lift arm 3 is computed (H) an the data from the sensor S1, S2 are updated.

In step 5, whether or not the bucket 5 is rising is determined by comparing the new value of H to the old value of H.

When the bucket 5 is rising, whether or not the detected height, H, is greater than or equal to the lower kickout position $H_{low}$, is judged in step 6. When said height, H, is greater than or equal to $H_{low}$, the Ground Stop Flag is turned off (step 7).

If H is less than $H_{low}$, the processing proceeds to step 8. Whether or not the upper lift kickout is effective (on), a determined by the lift control lever position sensor 28 is judged in step 8. If it is effective, processing proceeds to step 9.

If H is greater or equal to the upper kickout position, $H_{upp}$, (step 9), the electromagnetic solenoid 10 is energized (step 10) and the lift control lever 14 is released and returned to the neutral (HOLD) position.

If H is less than $H_{upp}$, the electromagnetic solenoid is de-energized in step 11.

Figure 8B:
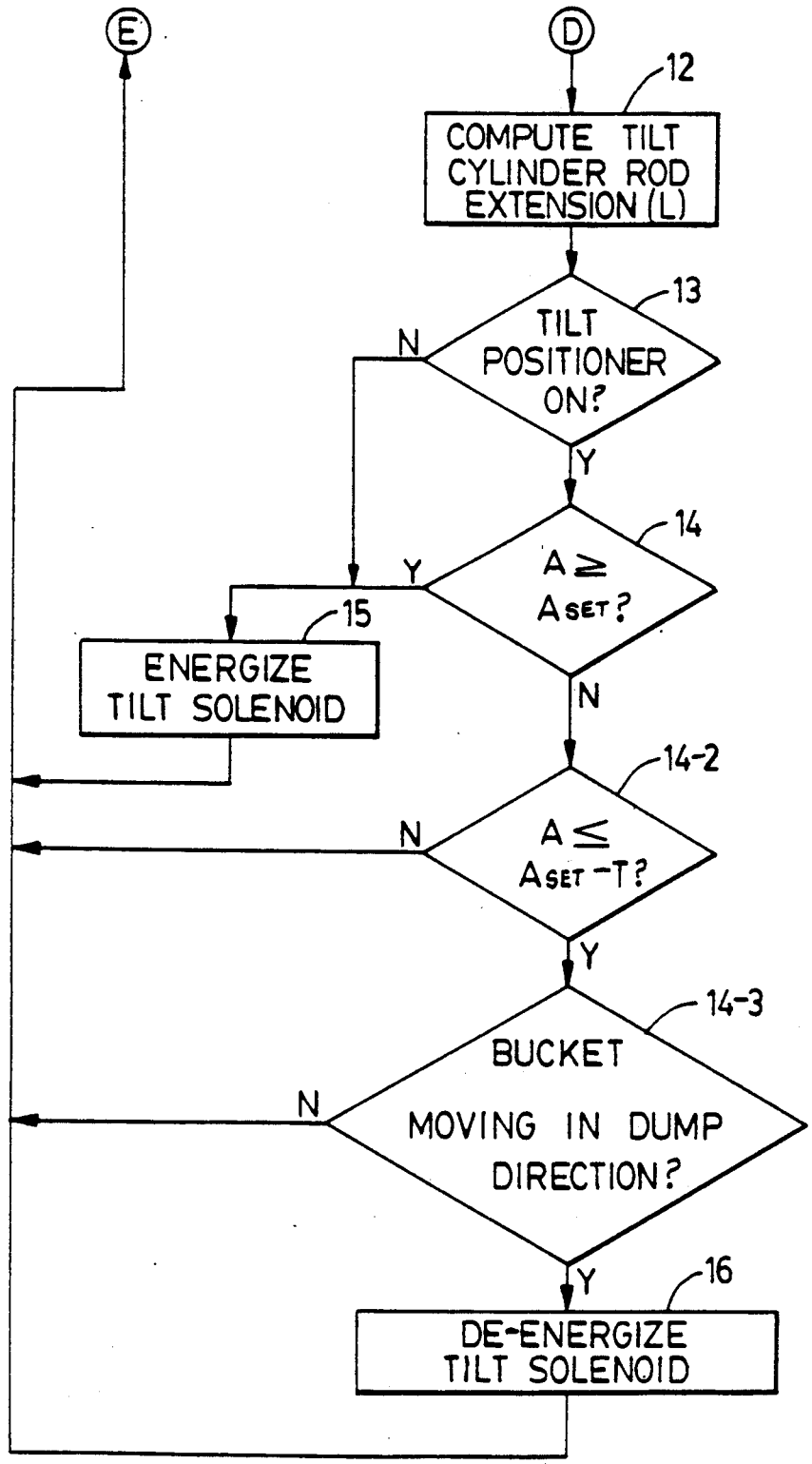

FIG. 8*b* shows the process for energizing and de-energizing the tilt electromagnetic solenoid 11.

In step 12 the tilt angle (A) of the bucket 5 is computed.

In step 13 whether or not the operation of the bucket positioner (kickout for tilting) is effective (on) is determined from the tilt control lever position sensor 38.

When it is effective, processing proceeds to step 14. If A is greater or equal to the desired bucket tilt angle, $A_{set}$ (step 14), the tilt electromagnetic solenoid 11 is energized (step 15) and the tilt control lever 16 is released an returned to the neutral (HOLD) position.

Also, if the tilt positioner is not effective in step 13, the processing proceeds to step 15.

If A is less than $A_{set}$ (step 14), processing continues to step 14-2. If A is less than or equal to A minus a tolerance, T (step 14-2) and if the bucket 5 is moving in the dump direction (step 14-3) the tilt electromagnetic solenoid 1 is de-energized (step 16).

If the solenoid 11 is energized (step 15) or if the solenoid 11 is de-energized (step 16), processing returns to step 1-2.

Figure 8C:
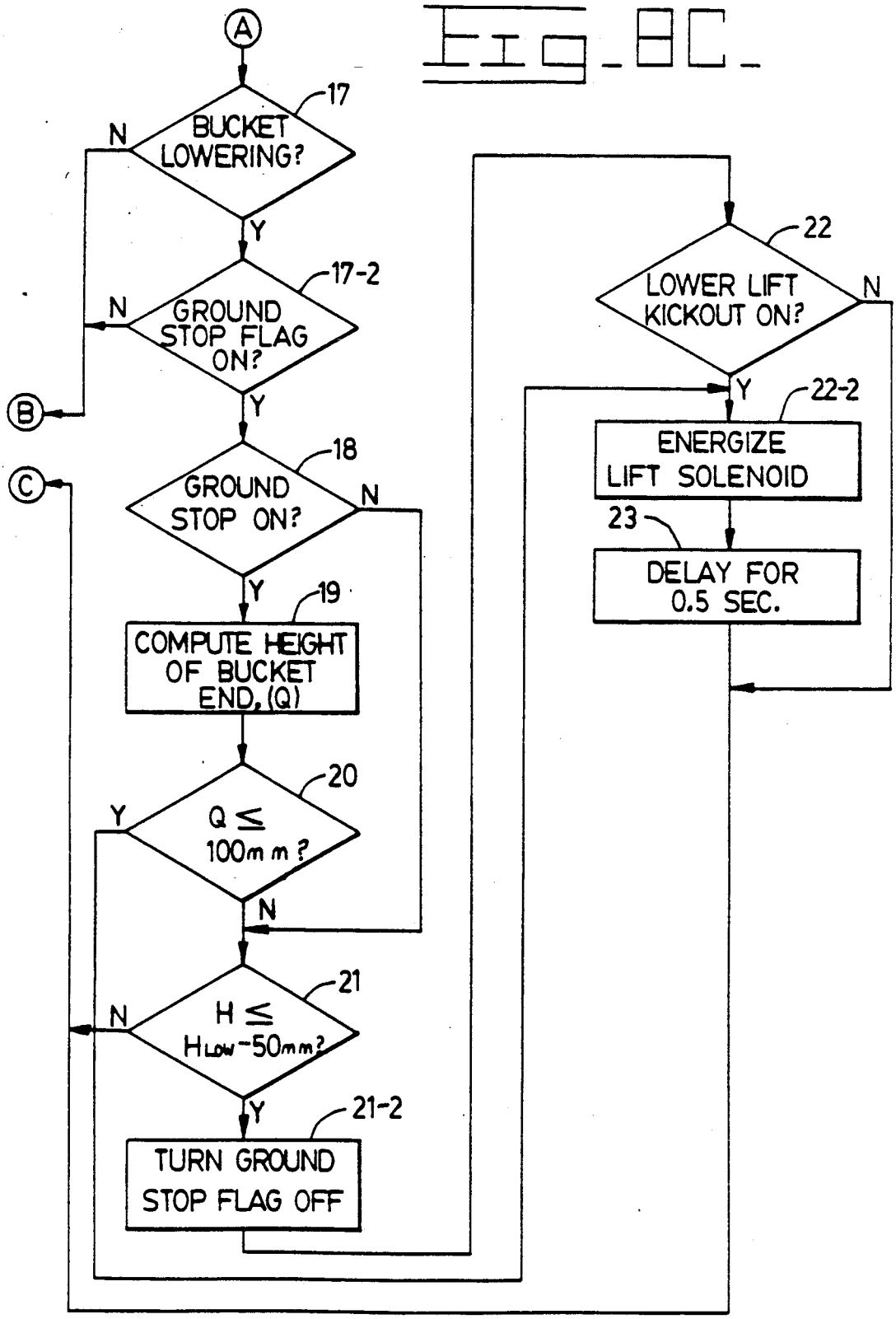

FIG. 8*c* shows the process for unlocking the lift control lever 14 before the bucket 5 hits the ground.

If the bucket 5 is being lowered (step 17) and the Ground Stop Flag is on (step 17-2), processing proceeds to step 18. Otherwise, processing continues at step 11.

In step 18, whether or not the safety ground stop is effective is judged (the safety ground stop stops the lowering of the lift arms 3 just before the end of the bucket 5 reaching the ground).

When the judgement in step 18 is YES, the height of the bucket end (Q) is computed from the readings from the senor S1, S2 in step 19.

Then, whether or not is within the allowed range (0 to 100 mm in this embodiment) is judged in step 20.

When said the height, Q, is within the given range in step 20, the processing jumps to step 22-2.

When the height Q is not within the allowance range in step 20, whether or not the height H of the lift arm 3 is within the allowed range ($H_{low}$ minus 50 mm) is judged in step 21.

If H is within the allowance, the Ground Stop Flag is turned off in step 21-2.

In step 22, whether or not the lower lift kickout is effective is judged. If it is effective, in step 22-2 the lift electromagnetic solenoid 11 is energized. A 0.5 second delay (step 23) is added to ensure that the solenoid 11 has to disengage the locking lever 37.

If the lower kickout is not effective in step 22, the processing jumps to step 11.

By means of said operation, the bucket 5 can be stopped just before the bucket falls to the ground, regardless of $H_{low}$.

Also, the lower kickout detent 23 is used in combination with the FLOAT position of the lift control valve 4*a*. And when the float operation is required, a normal operation can be performed if the lower kickout is canceled.

The present invention is not restricted to the controlling of the bucket as described in the above embodiment. The implements to which the invention is applicable are a blade, a fork or the like, actuated by hydraulic cylinders.

Claims:

1. An automatic position control system (50) for a material loading vehicle (1) having a pivotally moveable bucket (5) connected to a pivotally moveable lift arm (3), said bucket (5) and lift arm (3) each being controllably and independently moveable to a multiplicity of preselected positions, said vehicle (1) having a power system (17) including a hydraulic pump (9) operably connected to a plurality of hydraulic cylinders (4, 6) for controllably moving the bucket (5) and lift arm (3) to said preselected positions, comprising:

a first lever (14) having locked and unlocked positions for raising the lift arm (3) and the bucket (5) and a position for lowering the lift arm (3) and;

a second lever (16) having locked and unlocked positions for pivoting the bucket (5) in a first direction and a position for pivoting the bucket (5) in a second, different direction, said first and second levers (14, 16) each being positioned in the power system (17) at a location between the pump (9) and the respective cylinders (4, 6);

operating means (S1, S2) for sensing the elevation of the bucket (5) and delivering an elevation signal (E) responsive to the elevation of said bucket (5), for sensing the orientation of the bucket (5) and delivering an orientation signal (O) responsive to the orientation of said bucket (5), and for developing a set point elevation signal (E') and a set point orientation signal (O'), responsive to respective preselected elevation and orientation positions of the bucket (5);

control means (51) for comparing elevation signals, (E) and (E'), and comparing orientation signals (O) and (O') and delivering an elevation control signal (EC) in response to the bucket (5) being at the preselected elevation and delivering an orientation control signal (OC) in response to the bucket (5) being at the preselected orientation;

first unlocking means (20) for moving the first lever (14) from the locked to the unlocked position in response to receiving the elevation control signal (EC); and, second unlocking means (30) for moving the second lever (16) from the locked to the unlocked position in response to receiving the orientation control signal (OC).

2. The automatic position control system (50), as set forth in claim 1, wherein the first lever (14) includes locked and unlocked positions for lowering the lift arm (3) and the bucket (5) and wherein said operating means (S1, S2) develops a set point signal, (E''), responsive to the respective preselected lower elevation position, compares position signals (E) and (E'') and delivers a controlling signal (EC') in response to the bucket (5) being at the preselected lower elevation.

3. The automatic position controlling system (50), as set forth in claim 2 wherein the first unlocking means (20) moves the first lever (14) from the locked to the unlocked position in response to receiving signal (EC').

4. The automatic position control system (50), as set forth in claim 1, wherein the second lever (16) includes locked and unlocked positions for pivoting the bucket (5) in the second direction and wherein said operating means (S1, S2) develops a set point orientation signal, (O''), responsive to the respective preselected orientation position, compares orientation signals, (O) and (O'') and delivers an orientation control signal (OC') in response to the bucket (5) being at the preselected orientation.

5. The automatic position control system (50), as set forth in claim 4, wherein the second unlocking means (30) moves the second lever (16) from the locked to the unlocked position in response to receiving the orientation control signal (OC').

6. The automatic position control system (50), a set forth in claim 1, including visual means (60) for displaying the actual elevation and orientation of the bucket (5).

7. The automatic position control system, (50) as set forth in claim 6, wherein the visual means (60) displays the preselected elevations and orientations of the bucket (5).

8. The automatic position control system (50), as set forth in claim 6, wherein the visual mean (60) displays the preselected elevation and orientation position in a specific order a the corresponding set point are developed.

9. The automatic position control system, (50) as set forth in claim 1, wherein the control means (51) stop downward movement of the bucket (5) before the bucket (5) hits the ground.

10. A control system for controllably positioning a bucket of material loading vehicle to a preselected position, said material handling vehicle having a lift arm pivotally connected to said material loading vehicle, said bucket being pivotally connected to said lift arm, comprising:

a lever having neutral, locked, and unlocked positions;

operating means for sensing one of the relative position of said lift arm with respect to said material handling vehicle and the relative position of said bucket with respect to said lift arm and responsively delivering a position signal;

means for receiving said position signal and responsively developing a setpoint signal corresponding to said preselected position;

means for sensing a condition of said lever corresponding to said lever being in said unlocked position and responsively delivering a first control signal and for sensing a condition of said lever being in said locked position and responsively delivering a second control signal;

means for receiving said first control signal and controllably moving said bucket in response to said first control signal, for receiving said second control signal, receiving said position signal, controllably moving said bucket towards said preselected position in response to said second control signal, comparing said position signal to said setpoint signal and delivering a third control signal in response to said position signal and said setpoint signal being substantially equal; and means for receiving said third control signal and responsively moving said lever from said locked position to said neutral position.

* * * * *